US005894256A

United States Patent [19]

Kobayashi et al.

[11] Patent Number: 5,894,256

[45] Date of Patent: Apr. 13, 1999

[54] MAGNET SWITCH FOR STARTER WITH ELASTICALLY DEFORMABLE CONTACT

[75] Inventors: Yasuhiko Kobayashi, Chita-gun; Tsutomu Shiga, Nukata-gun, both of Japan

[73] Assignee: Denso Corporation, Japan

[21] Appl. No.: 08/794,489

[22] Filed: Feb. 4, 1997

[30] Foreign Application Priority Data

Feb. 13, 1996 [JP] Japan ..... 8-025550

[51] Int. Cl.[6] ..... H01H 67/02

[52] U.S. Cl. ..... 335/126; 335/128; 335/131; 290/38 R; 290/48

[58] Field of Search ..... 335/126, 128, 335/131, 196, 83; 200/238, 241; 290/38 R, 48

[56] References Cited

U.S. PATENT DOCUMENTS 5,526,084 6/1996 Shiga et al. ..... 290/38 R

FOREIGN PATENT DOCUMENTS 61-13446 1/1986 Japan .

*Primary Examiner*—Renee S. Luebke

*Assistant Examiner*—Tuyen T. Nguyen

*Attorney, Agent, or Firm*—Pillsbury Madison & Sutro, LLP

[57] ABSTRACT

In a magnet switch, when an exciting coil is turned on to generate magnetic force, a plunger is moved by the magnetic force so that a movable contact contacts a fixed contact. The fixed contact includes an elastically deformable, flat plate-like elastic deformable portion having a contact portion which is contacted by the movable contact and a terminal bolt connected to a battery. When the movable contact contacts the contact portion of the fixed contact, the elastically deformable portion is elastically deformed by the collision force to absorb collision force, thereby preventing the bouncing of the movable contact.

13 Claims, 2 Drawing Sheets

MAGNET SWITCH FOR STARTER WITH ELASTICALLY DEFORMABLE CONTACT

CROSS REFERENCE TO RELATED APPLICATION

This application is based on and claims priority of Japanese Patent Application No. 8-25550 filed on Feb. 13, 1996, the contents of which are incorporated herein by reference.

BACKGROUND OF THE INVENTION

1. Field of the Invention

The present invention relates to a magnet switch for starter for supplying a battery electric current to a starter motor. More particularly, the present invention relates to an improved switch contact of a magnet switch for starter.

2. Related Art

In a magnet switch for starter, a movable contact is moved with a plunger when an exciting coil is turned on, and the movable contact contacts a fixed contact so that a battery electric current is supplied to a starter motor via the movable contact and the fixed contact.

When the movable contact contacts the fixed contact, the movable contact is likely to bounce against the fixed contact due to the collision impact of the movable contact with speed, contact abrasion caused by the large electric current sparks progresses. Those are negative factors against the recent demand for the long-life durability of a starter.

For solving this problem, one countermeasure is proposed in Japanese Utility Model Laid-open Publication No. 61-13446. In this conventional art, an elastically deformable contact plate, which is electrically connected to a fixed contact, is provided on the fixed contact at the side facing a movable contact in order to prevent the bounce of the movable contact when the movable contact is brought into contact with the contact plate.

According to the conventional art, because an electric power is supplied to the movable contact from the fixed contact via the elastic contact plate, degradation in performance is developed because of the voltage drop due to the addition of a contact portion. Further, the addition of the contact plate raises the cost of the magnet switch due to processing and assembling of the contact plate.

SUMMARY OF THE INVENTION

In the light of the foregoing problems, the present invention has an object to provide a magnet switch for starter that can prevent bouncing of a movable contact by absorbing collision impacts when the movable contact is brought into contact with a fixed contact, without causing voltage drop or increasing manufacturing cost.

According to the present invention, a contact portion of a fixed contact of a magnet switch is constructed by an elastically deformable metal.

When a movable contact moves with a plunger and contacts the contact portion of the fixed contact, movement energy upon contacting is absorbed and the movable contact is prevented from bouncing against the fixed contact because the fixed contact is elastically deformed when the movable contact is brought into contact with the fixed contact. Thus, abrasion of the movable contact and the fixed contact due to large electric current sparkings can be prevented, thereby assuring long-life durability of the magnet switch. In addition, because the movable contact and the fixed contact directly contact each other, no voltage drop is produced, thereby preventing degradation in performance.

Preferably, the fixed contact is formed into a simple flat plate configuration by flattening a part of a battery terminal bolt. The fixed contact is readily provided in a reduced cost.

Preferably, a part of the fixed contact is exposed outside the magnet switch for connection with a vehicle-mounted battery. More preferably, a plurality of grooves is formed on the contact portion so that contact pressure at the contact portion can be increased. This assures conducting the movable contact to the fixed contact even if there occurs moisture condensation or freezing on the contact portion.

Preferably, the contact portion of the fixed contact is made of copper and electrically welded onto other part of the fixed contact made of iron. Thus, the material cost can be reduced compared with the cost using copper for the whole parts. Furthermore, the rise in cost can be suppressed by performing the electric welding during flattening process.

Preferably, a space in which an elastically deformable portion is deformable is formed between a switch cover and the fixed contact so that the elastically deformable portion can be deformed without being interfered by the switch cover.

BRIEF DESCRIPTION OF THE DRAWINGS

Other objects, features and advantages of the present invention will become more apparent from the following detailed description of the preferred embodiments when read with reference to the accompany drawings, in which.

DETAILED DESCRIPTION OF THE PRESENTLY PREFERRED EMBODIMENTS

Next, a magnet switch for starter of the present invention is now described with reference to embodiments illustrated in the accompanying drawings.

(FIRST EMBODIMENT)

Figure 1:
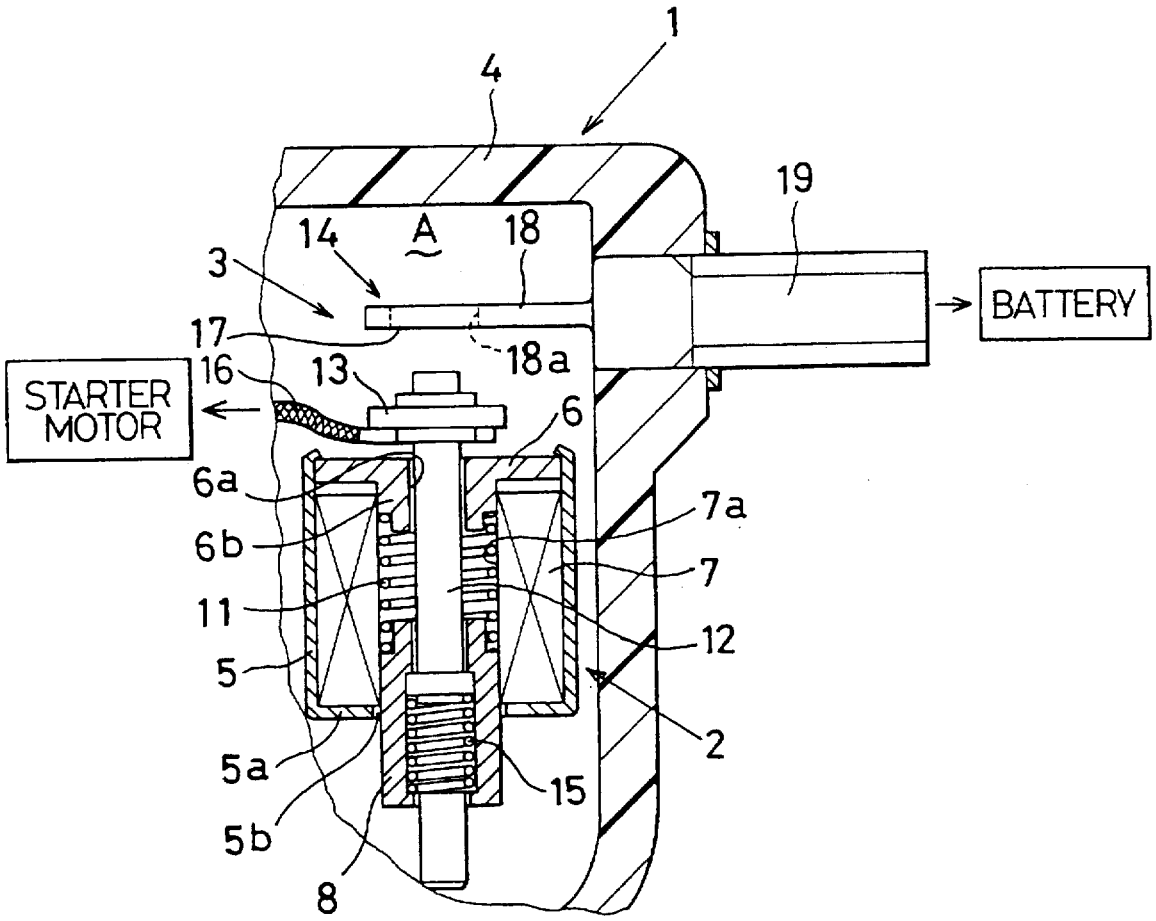
FIG. 1 is a cross-sectional view of a main part of a magnet switch according to a first embodiment of the present invention.

As shown in FIG. 1 and known well in the art, a magnet switch is for generating power for engaging a starter pinion (not shown) with a ring gear (not shown) of an engine when a starter switch (not shown) is turned on, and for supplying a battery electric current (not shown) to a starter motor (not shown). Magnet switch 1 includes an electromagnet part 2 and a switch part 3, and are disposed within a switch cover 4 made of electrically insulating material such as resin.

Magnet part 2 includes a yoke 5 in a shape of a cylinder with a bottom base 5*a*, a stator core 6 closing an upper opening of yoke 5, a cylindrical exciting coil 7 disposed in an inner space between the bottom of yoke 5 and stator core 6, and a plunger 8 disposed axially slidably inside exciting coil 7.

Yoke 5 is manufactured by processing magnetic metal (low carbon iron, for example) into a cylindrical shape with base 5*a* by cold forging. At a center of base 5*a*, a hole 5*b* is formed for receiving plunger 8 movably therethrough.

Stator core 6 is manufactured by processing magnetic metal (iron, for example) into a ring plate shape by cold forging. Stator core 6 includes a hole 6a at the center thereof for receiving a shaft 12. In addition, at the center of stator core 6, a cylindrical part protruding toward plunger 8 (in a downward direction in FIG. 1) is formed.

Exciting coil 7 is provided by winding an insulator-coated wire into a cylindrical shape around a sleeve 7a which is disposed around stator core 6. One end of exciting coil 7 is grounded to a vehicle body via yoke 5 and a starter housing (not shown), while the other end of exciting coil 7 is connectable to a vehicle-mounted battery (not shown) via the starter switch. When the starter switch is turned on, electric current is carried to exciting coil 7 so that exciting coil 7 generates magnetic force for attracting plunger 8 toward stator core 6.

Plunger 8 is a cylindrical magnetic metal (iron, for example) disposed slidably in the axial direction within the sleeve 7a fitted on the inner periphery of exciting coil 7. By a return spring 11 disposed between a cylindrical part of stator core 6 and plunger 8, plunger 8 is biased normally to a side away from stator core 6. Plunger 8 is then attracted to stator core 6 against the biasing force of return spring 11 when exciting coil 7 generates magnetic force.

Switch part 3 includes the shaft 12 supported by plunger 8, a movable contact 13 fixed to shaft 12 and a fixed contact 14 contactable to movable contact 13.

Shaft 12 is disposed slidably within hole 6a at the center of stator core 6. One end (bottom side in FIG. 1) of shaft 12 is supported movably up to the predetermined distance inside of plunger 8. One end of shaft 12 is in contact with a movement absorption spring 15 so that shaft 12 is biased normally toward the side of fixed contact 14.

Furthermore, at the other end (upper part in FIG. 1) of shaft 12 a movable contact 13 is fitted. When plunger 8 is attracted to stator core 6 and movable contact 13 contacts fixed contact 14, movement absorption spring 15 contracts not to interfere the attraction of plunger 8 to stator core 6.

Movable contact 13 is fixed to the other end (top part in FIG. 1) of shaft 12, as mentioned above, and is made of metal which is highly adaptable to other metal such as copper and highly conductive. In addition, movable contact 13 is connected to conductive brushes of the starter motor (not shown) via electric lead wires 16 for electric power supply to the starter motor.

Fixed contact 14 is made of copper and fixed to switch cover 4 in a manner to extend perpendicularly to the movement direction of movable contact 13. Fixed contact 14 includes an elastically deformable portion 18 having a contact portion 17 disposed inside switch cover 4 and a terminal bolt 19 disposed outside switch cover 4.

Elastically deformable portion 18 is formed by flattening one end of terminal bolt 19 into a flat plate configuration using a press machine, so that the flat plate portion becomes elastically deformable. The flat portion is disposed in parallel with the plane of movable contact 13. In addition, elastically deformable portion 18 is provided for relieving the collision force by elastic deformation thereof when contacted by movable contact 13. Further, between switch cover 4 and elastically deformable portion 18, a space A larger than the deforming amount of elastically deformable portion 18 is provided to allow deformation of portion 18 therein.

Figure 2:
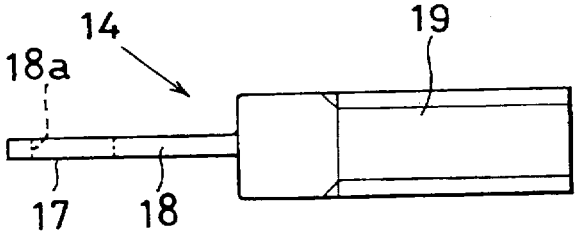
FIG. 2 is a side view of a fixed contact according to the first embodiment.
Figure 3:
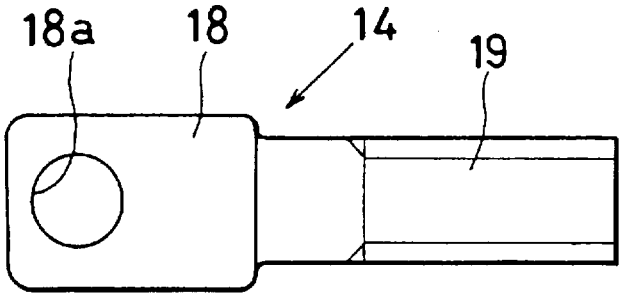
FIG. 3 is a plan view of the fixed contact according to the first embodiment.

Contact portion 17 is provided on the flattened elastically deformable portion 18 at the side of movable contact 13 and also at a part which movable contact 13 contacts when movable contact 13 is moved in the upper direction in FIG. 1. Further, as shown in FIGS. 2 and 3, elastically deformable portion 18 including contact portion 17 has a hole 18a for passing top end of shaft 12 therethrough and assuring electric contact of movable contact 13 with contact portion 17.

A terminal bolt 19 is a bolt to be connected to a battery cable (not shown) connected to the vehicle-mounted battery.

Next, the operation of the above-mentioned embodiment will be described.

When the starter switch (not shown) is turned on and exciting coil 7 is energized, exciting coil 7 generates magnetic force so that plunger 8 is moved to the side of stator core 6 by the magnetic force. By this movement of plunger 8 to stator core 6, shaft 12 and movable contact 13 is moved upward in FIG. 1, and movable contact 13 contacts fixed contact 14.

When movable contact 13 contacts fixed contact 14, flat plate-shaped elastically deformable portion 18 deforms elastically or resiliently by the collision force, and the collision force due to the contact is relieved. Therefore, movable contact 13 is unlikely to bounce at fixed contact 14 when the movable contact 13 contacts fixed contact 14.

In the meantime, when movable contact 13 contacts fixed contact 14, the electric current of the vehicle-mounted battery is supplied to the starter motor via fixed contact 14 and movable contact 13, thereby driving the starter motor.

According to magnet switch 1 for starter of the present embodiment, as mentioned in the operation, when movable contact 13 contacts fixed contact 14, elastically deformable portion 18 elastically deforms to relieve the collision force due to the contact, thereby preventing bouncing of movable contact 13 against fixed contact 14.

Accordingly, because movable contact 13 does not bounce when movable contact 13 contacts fixed contact 14, the abrasion of movable contact 13 and fixed contact 14 due to large electric current sparkings caused by bouncing can be prevented and switch part 3 can be durable for long life, thereby consequently lengthening life of starter.

In addition, because movable contact 13 and fixed contact 14 directly contact each other, the voltage drop caused by a component part used for preventing the bounce (such as a contact plate in the prior art) described in the prior art does not occur and degradation in performance of starter due to the additional bounce prevention member can be prevented.

Further, no additional part for preventing the bounce is necessary, thereby suppressing the rise in cost for the bounce prevention.

On the other hand, elastically deformable portion 18 of fixed contact 14 including contact portion 17 of fixed contact 14 is formed into a simple flat plate configuration, and this flat configuration is formed by flattening one end of terminal bolt 19. Therefore, fixed contact 14 is readily provided in the flat plate configuration, thereby suppressing the manufacturing cost of fixed contact 14 which performs the bounce prevention as well.

(SECOND EMBODIMENT)

Figure 4:
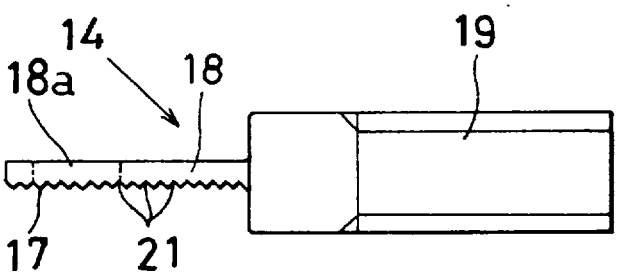
FIG. 4 is a side view of a fixed contact according to a second embodiment of the present invention.

According to the second embodiment, a large number of grooves 21 are formed on contact portion 17 as shown in FIG. 4. These grooves 21 are formed on the surface at the side of movable contact 13 when elastically deformable portion 18 is formed by flattening.

Terminal bolt 19 of fixed contact 14 is structured to be exposed outside of switch cover 4. For this reason, if the external or ambient air temperature is low such as during winter, it is likely that moisture condenses on contact portion 17 in switch cover 4 and that the condensed moisture freezes.

Therefore, according to the present embodiment, by forming plurality of grooves 21 on contact portion 17, the contact pressure of contact portion 17 can be increased, and the frozen condensation can be demolished if the condensed moisture freezes. Consequently, even if there is condensation or freezing on the surface of fixed contact 14, movable contact 13 and fixed contact 14 can be assuredly conducted.

(THIRD EMBODIMENT)

Figure 5:
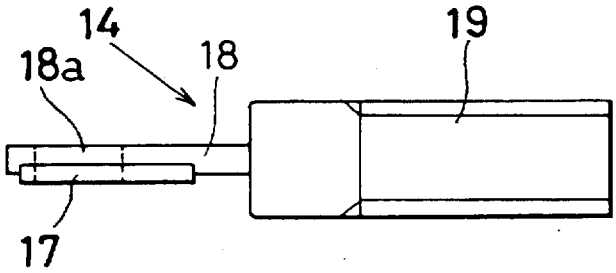
FIG. 5 is a side view of a fixed contact according to a third embodiment of the present invention.

According to the third embodiment, as shown in FIG. 5, a fixed contact 14 is provided with contact portion 17 made of copper, while other elastically deformable portion 18 and terminal bolt 19 are made of iron. Copper-made contact portion 17 is formed by joining contact portion 17 to elastically deformable portion 18 at the time flat plate-shaped elastically deformable portion 18 is formed by flattening one end of iron-made terminal bolt 19.

According to the third embodiment, since contact portion 17 is made of copper and other elastically deformable portion 18 and terminal bolt 19 are made of iron, the material cost can be reduced compared with the cost using copper for the whole parts. In addition, since copper-made contact portion 17 is joined to iron-made elastically deformable portion 18 when elastically deformable portion 18 is flattened, the manufacturing process can be simplified, thereby suppressing the rise in the manufacturing cost.

(MODIFICATIONS)

The foregoing embodiments show examples in which terminal bolt 19 and elastically deformable portion 18 are provided perpendicularly to the movement direction of movable contact 13. However, terminal bolt 19 may be disposed in parallel with the movement direction of movable contact 13 and elastically deformable portion 18 may be bent in an L-shape.

Further, the foregoing embodiments show examples in which the starter motor is connected directly to movable contact 13. However, fixed contact may be separated into two parts, and the starter motor may be connected to one part while the vehicle-mounted battery may be connected to the other part of fixed contact 14. The two parts of fixed contact 14 may be opened and closed by one movable contact 13.

Other modifications and variations are also possible without departing from the spirit and scope of the invention.

What is claimed is:

1. A magnet switch for starter for supplying an electric current from a battery to a starter motor, said magnet switch comprising:

an exciting coil for generating magnetic force by receiving an electric current;

a plunger movable by said magnetic force generated by said exciting coil;

a movable contact movable with said plunger; and a fixed contact formed by flattening a portion of a battery terminal bolt to form a flat plate portion and a terminal bolt portion integral therewith, said terminal bolt portion being connectable to said battery for supplying said electric current to said starter motor, said flat plate portion having a contact portion for contact with said movable contact, said flat plate portion having an elastically deformable portion which deforms upon a contact with said movable contact to supply said electric current from said battery to said starter motor.

2. A magnet switch for starter according to claim 3, wherein:

said contact portion is formed with a plurality of grooves on a side facing said movable contact.

3. A magnet switch for starter for supplying an electric current from a battery to a starter motor, said magnet switch comprising:

an exciting coil for generating magnetic force by receiving an electric current;

a plunger movable by said magnetic force generated by said exciting coil;

a movable contact movable with said plunger; and a fixed contact formed by flattening a portion of a battery terminal bolt to form a flat plate portion and a terminal bolt portion, said terminal bolt portion being connectable to said battery for supplying said electric current to said starter motor, said flat plate portion having a contact portion for contact with said movable contact, said flat plate portion having an elastically deformable portion which deforms upon a contact with said movable contact to supply said electric current from said battery to said starter motor, wherein:

said contact portion is made of copper and said elastically deformable portion is made of iron; and said contact portion is joined to said elastically deformable portion when said flat plate portion is flattened.

4. A magnet switch for starter for supplying an electric current from a battery to a starter motor, said magnet switch comprising:

an exciting coil for generating magnetic force by receiving an electric current;

a plunger movable by said magnetic force generated by said exciting coil;

a movable contact movable with said plunger; and a fixed contact formed by flattening a portion of a battery terminal bolt to form a flat plate portion and a terminal bolt portion, said terminal bolt portion being connectable to said battery for supplying said electric current to said starter motor, said flat plate portion having a contact portion for contact with said movable contact, said flat plate portion having an elastically deformable portion which deforms upon a contact with said movable contact to supply said electric current from said battery to said starter motor, wherein:

said contact portion is formed with a plurality of grooves on a side facing said movable contact;

said contact portion is made of copper and said elastically deformable portion is made of iron; and said contact portion is joined to said elastically deformable portion when said flat plate portion is flattened.

5. A magnet switch for starter according to claim 1, wherein:

said fixed contact is covered by a switch cover and a space is formed between said switch cover and said fixed contact to allow deformation of said elastically deformable portion therein.

6. A magnet switch for starter according to claim 1, wherein:

said movable contact is connected to said starter motor directly; and said fixed contact is made of a single piece of member.

7. A magnet switch for starter, comprising:

an insulating cover;

an exciting coil disposed in said insulating cover for generating a magnetic force when energized electrically;

a plunger movably disposed in said exciting coil and having a movable contact for controlling energization of a starter motor; and a terminal bolt fixed to said insulating cover, and having an outwardly extending portion for connection with a battery and an inwardly extending portion formed into an elastically deformable plate for contact with said movable contact, said elastically deformable plate being formed by flattening a part of said terminal bolt, the elastically deformable part being integral with the outwardly extending portion of the terminal bolt and extending from a diametrical center of the outwardly extending portion.

8. A magnet switch for starter according to claim 7, wherein:

said elastically deformable plate is formed with a plurality of grooves at a side facing said movable contact.

9. A magnet switch for starter according to claim 8, wherein:

said inwardly extending portion and said outwardly extending portion are made of iron.

10. A magnet switch for starter, comprising:

an insulating cover;

an exciting coil disposed in said insulating cover for generating a magnetic force when energized electrically;

a plunger movably disposed in said exciting coil and having a movable contact for controlling energization of a starter motor;

a terminal bolt fixed to said insulating cover, and having an outwardly extending portion for connection with a battery and an inwardly extending portion formed into an elastically deformable plate for contact with said movable contact; and a contact portion made of copper and electrically welded to said elastically deformable plate at a side facing said movable contact, wherein:

said elastically deformable plate is formed with a plurality of grooves at a side facing said movable contact, and said inwardly extending portion and said outwardly extending portion are made of iron.

11. A magnet switch for starter according to claim 7, wherein:

said inwardly extending portion is divided into two, one and the other of which are in electrical connection with said outwardly extending portion and with a starter motor, respectively.

12. A magnet switch for starter according to claim 1, wherein said fixed contact extends perpendicularly to a direction of movement of the movable contact.

13. A magnet switch for starter according to claim 7, wherein said terminal bolt extends perpendicularly to a direction of movement of the movable contact.

* * * * *